US009604375B2

(12) United States Patent
Bohmer et al.

(10) Patent No.: US 9,604,375 B2
(45) **Date of Patent: *Mar. 28, 2017**

(54) RAZOR WITH BLADE HEATING SYSTEM

(71) Applicants: Display Matrix Corporation, Randolph, NJ (US); L.P.I. Consumer Products, Inc., Pompano Beach, FL (US)

(72) Inventors: William Bohmer, Randolph, NJ (US); Louis D. Tomassetti, Pompano Beach, FL (US)

(73) Assignee: HEATED BLADES HOLDING COMPANY, LLC, Pompano Beach, FL (US)

( * ) Notice: Subject to any disclaimer, the term of this patent is extended or adjusted under 35 U.S.C. 154(b) by 19 days.

This patent is subject to a terminal disclaimer.

(21) Appl. No.: 14/254,355

(22) Filed: Apr. 16, 2014

(65) Prior Publication Data

US 2014/0245611 A1 Sep. 4, 2014

Related U.S. Application Data

(63) Continuation-in-part of application No. 13/110,031, filed on May 18, 2011, now Pat. No. 8,713,801.

(51) Int. Cl.
*B26B 21/48* (2006.01)

(52) U.S. Cl.
CPC ..... *B26B 21/48* (2013.01)

(58) Field of Classification Search
CPC ..... B26B 21/48
USPC ..... 30/34.05, 140, 50, 169, 346.58, 123; 219/50, 201, 221, 538
See application file for complete search history.

(56) References Cited

U.S. PATENT DOCUMENTS 956,604 A * 5/1910 Savoy ..... B26B 3/00 219/233
1,291,318 A * 1/1919 White ..... B26B 21/40 30/140
2,622,319 A * 12/1952 Hunt ..... B26B 21/48 219/227

(Continued)

OTHER PUBLICATIONS

The Physics Hypertextbook, Elert, Glenn, Electrical Resistance, available on May 6, 2016, at http://physics.info/electric-resistance/.*

*Primary Examiner* — Jonathan Riley
(74) *Attorney, Agent, or Firm* — Robert M. Downey, P.A.

(57) ABSTRACT

A blade cartridge for a shaving razor contains a series of parallel blades and at least two contact segments as part of an electric circuit connected to the blades at spaced intervals to provide an electric current flow through the blades in a manner that provides more efficient heat distribution across the length of the blades. A radiator effect is created wherein heat produced by the contact segments passes between the blades towards the cutting edge of the blades. The combination of the heat produced by the electric current flow through the conductive blades and the heat produced by the contact segments provides a dual heat process that makes it easier to adjust and control the temperature to a desired stable heat temperature. A thin conductive film may be fitted to be in contact with the ends of the blades to insure conductivity throughout the entire length of each blade.

3 Claims, 3 Drawing Sheets

(56) References Cited

U.S. PATENT DOCUMENTS

| | | | | | |
|---|---|---|---|---|---|
| 3,467,818 | A * | 9/1969 | Ballentine | H05B 3/84 | 219/203 |
| 4,207,896 | A * | 6/1980 | Shaw | A61B 18/08 | 219/233 |
| 4,209,017 | A * | 6/1980 | Shaw | A61B 18/00 | 219/227 |
| 4,231,371 | A * | 11/1980 | Lipp | A61B 18/082 | 219/233 |
| 4,280,046 | A * | 7/1981 | Shimotori | H05B 3/18 | 174/102 R |
| 4,364,390 | A * | 12/1982 | Shaw | A61B 18/08 | 219/233 |
| 4,485,810 | A * | 12/1984 | Beard | A61B 17/3213 | 219/228 |
| 4,622,966 | A * | 11/1986 | Beard | A61B 17/3213 | 219/233 |
| 5,275,672 | A * | 1/1994 | Althaus | C21D 6/04 | 148/325 |
| 6,817,101 | B1 * | 11/2004 | Bohmer | B26B 21/48 | 30/140 |
| 6,822,197 | B1 * | 11/2004 | Mattfield | B44D 3/168 | 15/236.01 |
| 7,272,991 | B2 * | 9/2007 | Aviza | B26B 21/4068 | 30/50 |
| 2006/0117568 | A1 * | 6/2006 | Tomassetti | B26B 21/165 | 30/34.05 |
| 2007/0137050 | A1 * | 6/2007 | Xu | B26B 21/58 | 30/346.54 |
| 2009/0255123 | A1 * | 10/2009 | Tomassetti | B26B 21/48 | 30/34.05 |
| 2009/0288304 | A1 * | 11/2009 | Denkert | B26B 21/227 | 30/346.61 |

* cited by examiner

RAZOR WITH BLADE HEATING SYSTEM

This patent application is a Continuation-In-Part (CIP) of co-pending patent application Ser. No. 13/110,031 filed May 18, 2011.

BACKGROUND OF THE INVENTION

Field of the Invention

The present invention relates to razors for shaving and, more particularly, to a system for electrically heating a series of razor blades within a blade cartridge.

Discussion of the Related Art

It is known that the cutting edge of a razor blade cuts hair more effectively when it is warm or hot. It is also common practice to place the razor blades under hot running water in order to heat the blades just prior to stroking the blades over the skin in order to cut the hairs. However, the heat cutting performance of the blades lasts only a short time during the beginning of the shaving stroke. Within seconds, the temperature of the skin surface, hairs and blade are quickly reduced due to exposure to the ambient air. Ideally, it is best to maintain the blades, including the cutting edges of the blades, heated to a warm temperature throughout the shaving process to achieve better performance and increased shaving comfort.

One particular prior art blade heating invention, disclosed in U.S. Pat. No. 6,817,101 B1 to Bohmer, provides a shaving system with a continuously heated blade cartridge throughout the shaving stroke. Heating the blades is attained by applying a measured amount of electric current to the blade cartridge by means of conductors connected to each side of the blade cartridge and extended in the form of contacts at the connection of the blade cartridge to a razor handle. Electric current is provided by a primary battery contained in a compartment in the razor handle. Current provided by the battery renders optimum heat generation in the blades of the cartridge and the degree of heat can be adjusted by means of resistors connected in series with the blades and the blade cartridge. A switch closes the circuit.

The present invention improves on the past heated blade systems by providing efficient heat distribution across each razor blade within a blade cartridge, as well as in between each razor blade. Specifically, the present invention uses two high resistance electrically conductive contact segments, such as Nichrome, connected to the back edges of the blades to deliver electric current flow through the blades as part of an electric circuit. The contact segments are connected to a power source (e.g., battery) by means of standard conductive wires such as copper or brass wire conductors. Nichrome (an alloy of nickel, chromium, and iron) is an example of a high electrical resistance conductor that can be used as the material for the contact segments. Due to the nature and material characteristics of the contact segments, as well as the junction of dissimilar metals between the contact segments, the standard wire conductors (e.g., copper or brass) and the blades, heat is generated in the contact segments causing them to become warm or hot when electric current flows through the circuit. This heat can be controlled by varying the diameter, shape, mass, and length of the contact segments for a given voltage. The spacing of the contact segments on the back edges of the blades helps to achieve more uniform heat distribution. Moreover, a radiator effect is created wherein heat produced by the contact segments, as a result of their high resistance, passes between the blades towards the cutting edges of the blades. A dual heat process is achieved by the combination of the heat produced by the electrically conductive blades as part of the electric circuit and the heat from the contact segments radiating between the blades. The improved means of heating the razor blades of the present invention provides increased efficiency of battery power usage, while also generating maximum heat with minimum voltage.

SUMMARY OF THE INVENTION

A blade cartridge for a shaving razor contains one or more blades, and at least two contact segments as part of an electric circuit connected to the blades at spaced intervals to provide an electric current flow through the blades in a manner that provides more efficient heat distribution across the length of the blades. The two or more contact segments are connected to a power source (e.g., battery) by means of standard conductive wires, such as copper or brass wire conductors. The contact segments are made of a high resistance material and may be connected to the blades at locations closer to the center of the blades or further apart, towards the ends of the blades, to achieve optimal heat distribution along the entire length of the blades. Nichrome is an example of a high resistance conductor that can be used for the contact segments. The ends of the blades may be held in place by staples or metal bands that are insulated from the electric circuit. A thin conductive film may be fitted to the opposite ends of the blades to insure conductivity throughout the entire length of each blade. When current flows through the high resistance contact segments, heat is generated and the contact segments become warm or hot. A radiator effect is created wherein heat produced by the contact segments passes between the blades towards the cutting edge of the blades. The combination of the heat produced by the electric current flow through the conductive blades and the heat produced by the contact segments provides a dual heat process that makes it easier to adjust and control the temperature to a desired stable heat temperature. Use of a high resistance conductor, such as Nichrome, for the contact segments provides maximum heat with minimal voltage, while also controlling thermal runaway. The blade heating system of the present invention is easily adapted to existing blade cartridge designs as a retro-fit. The blade heating system may also be incorporated into a newly manufactured blade cartridge design.

OBJECTS AND ADVANTAGES OF THE INVENTION

Considering the foregoing, it is a primary object of the present invention to provide a blade heating system for a razor that more uniformly distributes heat energy across one or more blades within a blade cartridge of a razor to ensure more consistent heat along the entire length of the blades.

It is a further object of the present invention to provide a blade heating system in a razor that allows for a dual heating effect, wherein the electrically conductive blades are heated as part of an electric circuit while heat is also generated by electric contact segments and passes between the blades towards the cutting edge of the blades.

It is a further object of the present invention to provide a blade heating system in a razor that provides maximum heat with minimum voltage.

It is still a further object of the present invention to provide a blade heating system in a razor that provides for increased efficiency of battery power consumption.

It is still a further object of the present invention to provide an efficient blade heating system for a shaving razor that can be easily adapted to existing blade cartridge designs.

These and other objects and advantages of the present invention are more readily apparent with reference to the following detailed description and the accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Referring to the several views of the drawings, the blade heating system of the present invention is shown and is generally indicated as 10.

Figure 1:
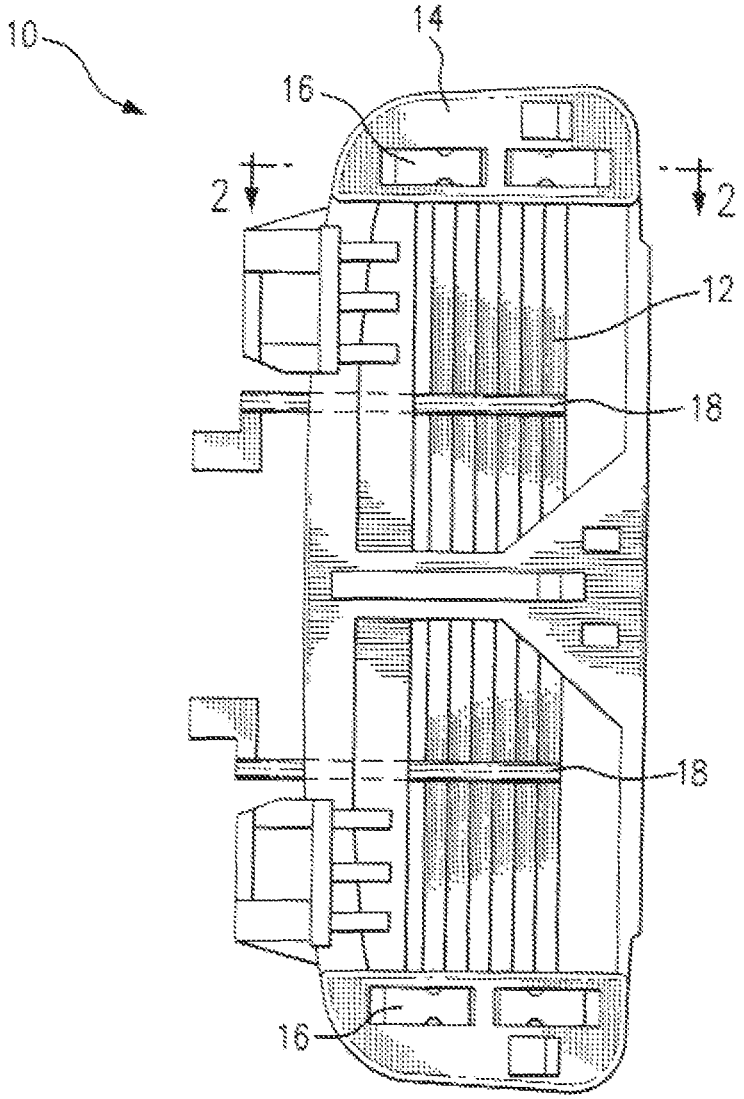
FIG. 1 is a bottom plan view of a blade cartridge according to a preferred embodiment of the blade heating system of the present invention.

Referring to FIG. 1, the blade heating system 10 includes a series of razor blades 12 affixed in parallel relation to each other within a blade cartridge 14. In one embodiment, a pair of staples 16 located at opposite sides of the blade cartridge 14 hold the razor blades 12 in place. Each blade 12 is formed as a unitary body that is structured and disposed for receiving an electric current flow therethrough, wherein each unitary body includes a top side 13, a bottom side 15, a front cutting edge 17, a back non-cutting edge 19 and a back surface 21 between the back non-cutting edge 19 and the top side 13, and the top side 13 extending from the front cutting edge 17 to the back non-cutting edge 19, and the bottom side 15 extending from the front cutting edge 17 to the back surface 21.

Figure 2:
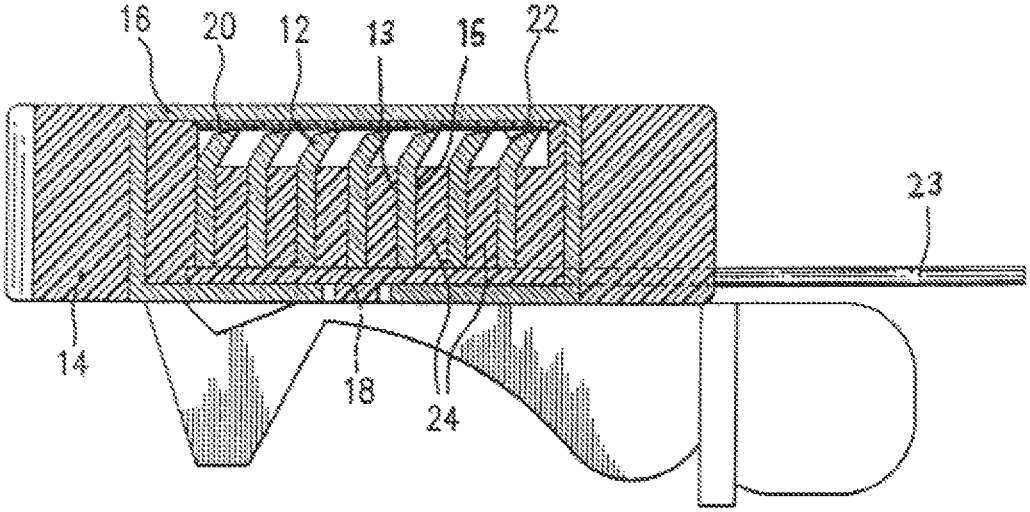
FIG. 2 is a cross-sectional view taken along the plane of the line 2-2 in FIG. 1.

Two or more spaced electric contact segments 18 in connection with wires 23 are held in contact with the back edges of one or more of the razor blades 12 to form an electric circuit. When the wires 23 and contact segments 18 are supplied with an electric current from an electric power source (e.g., a battery), the current flows through the electrically conductive blades 12 and heat is generated in the blades. The heat travels through the length of each blade 12 that is contacted by the contact segment 18 so that the entire blade is heated. While the front cutting edges of the blades 12 have a protective coating for safety during the shaving process, the back edges of the blades 12 are not coated in order to preserve the conductive properties of the blades 12. The staples 16 may be made of a non-conductive material. Alternatively, as illustrated in FIG. 2, an insulating material 20 is placed between the blade surface and each staple 16 to prevent heating or overheating of the staples 16. A thin conductive film 22 can be added between the insulating material 20 and blades 12 so that the film 22 is in contact with the blades 12. This may help to promote better conductivity and heating throughout the entire length of all of the blades 12 in the cartridge 14. A blade separator 24 holds the blades 12 separated within the blade cartridge 14, maintaining the blades 12 at an optimally angled position for shaving. The contact points of the two contact segments 18 may be closer to the center of the blades or further apart, towards the ends of the blades. The ideal spacing between these contact points of the two contact segments 18 is that which achieves the best heat distribution throughout the entire lengths of the blades.

In a preferred embodiment, the spaced contact segments 18 are composed of Nichrome or other electrically conductive material that has a generally high resistance and which has the property of generating heat when electric current flows through the conductive material of the contact segments 18, while also controlling thermal runaway. A radiator effect is created as a result of the heat produced by the contact segments 18 passing between the blades 12 towards the cutting edge of the blades. The thin conductive film 22 is composed of aluminum or other electrically conductive material, the wires 23 are composed of steel or other electrically conductive material, and the razor blades 12 are composed of stainless steel. In a preferred embodiment, the resistance of the contact segments 18 is higher than the resistance of the wires 23 for maximizing the efficiency of the heat produced by the contact segments 18. Dissimilar metals in contact with one another may help to promote greater heat levels and uniform heat distribution when supplied with an electric current. Moreover, the contact points of the dissimilar metals creates heat that may promote the radiator effect. The combination of the heat produced by the electric current flow through the conductive blades and the heat produced by the contact segments provides a dual heat process that makes it easier to adjust and control the temperature to a desired stable heat temperature.

Figure 3:
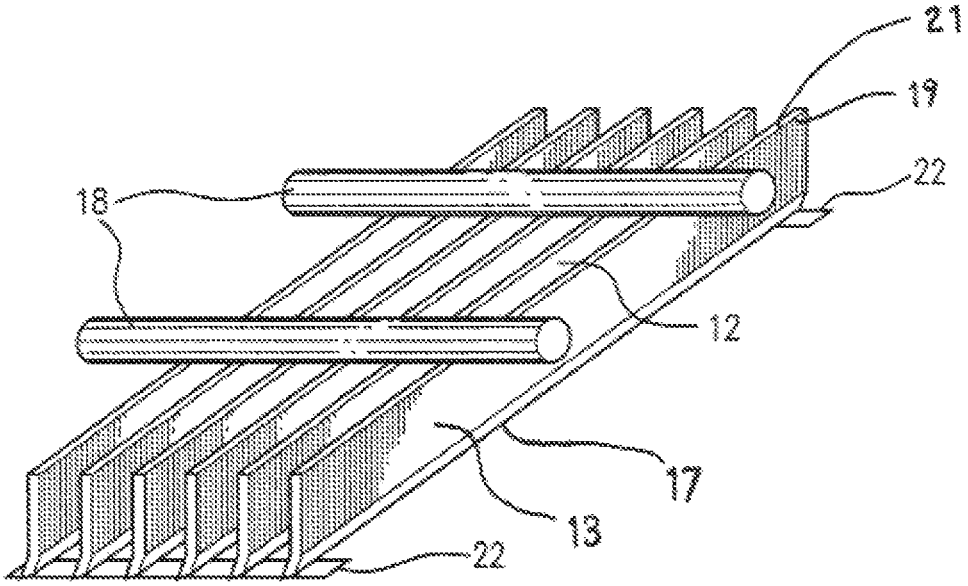
FIG. 3 is an isolated perspective view showing two spaced contact segments in contact with the back edges of the razor blades.

Referring to FIG. 3, an electric current is applied to the spaced contact segments 18 and spreads across a series circuit created by the contact points of the spaced contact segments 18, the thin conductive film 22, and the blades 12. The multiple contact points increase the efficiency of the battery power required to maintain more uniform heating across the blades 12. The blade heating system can be easily adapted to existing blade cartridge designs presently sold in the marketplace. Moreover, the razor may be provided with a thermostat switch to control electric current flow to the blades and, accordingly, the temperature of the blades.

While the present invention has been shown and described in accordance with a preferred embodiment, it is recognized that departures from the instant disclosure are contemplated within the spirit and scope of the present invention which are not to be limited except as defined in the following claims as interpreted under the Doctrine of Equivalents.

What is claimed is:

1. A razor blade heating system comprising:

at least one electrically conductive blade formed as a unitary body and being structured and disposed for receiving an electric current flow through said unitary body, and having a top side, a bottom side, a front cutting edge, at least one back non-cutting edge and a back surface between the at least one back non-cutting edge and the top side, and the top side extending from the front cutting edge to the at least one back non-cutting edge, the bottom side extending from the front cutting edge to the back surface, and the at least one electrically conductive blade further including opposite outboard ends;

a blade cartridge structured and configured for containing said at least one electrically conductive blade within said cartridge so that the cutting edge is operatively positioned for cutting hairs when the blade cartridge is moved along the skin surface of a user;

at least one electrically conductive contact segment held in contact with the at least one back non-cutting edge and the back surface of said at least one electrically conductive blade for delivering an electric current from a power source to the at least one back non-cutting edge and into the unitary body defining the at least one electrically conductive blade so that the electric current flows through said at least one electrically conductive blade and said at least one electrically conductive blade is heated across an entire length of the blade;

at least one wire conductor connecting between the power source and said at least one electrically conductive contact segment for directing flow of the electric current from the power source to said at least one electrically conductive contact segment; and said at least one electrically conductive contact segment having a higher electrically conductive resistance than said at least one wire conductor, thereby causing the at least one electrically conductive contact segment to increase in temperature and release heat towards the skin surface of the user when the electric current flows through said at least one electrically conductive contact segment and the blade cartridge is moved along the skin surface of the user.

2. A razor blade heating system comprising:

a plurality of electrically conductive blades each formed as a unitary body and being structured and disposed for receiving an electric current flow through said unitary body, and having a top side, a bottom side, a front cutting edge, at least one back non-cutting edge and a back surface between the at least one back non-cutting edge and the top side, and the top side extending from the front cutting edge to the at least one back non-cutting edge, the bottom side extending from the front cutting edge to the back surface, and each of the plurality of electrically conductive blades further includes opposite outboard ends;

a blade cartridge structured and configured for containing said plurality of electrically conductive blades within said cartridge so that the front cutting edge of each of said plurality of electrically conductive blades is operably positioned in parallel, spaced relation for cutting hairs when the blade cartridge is moved along the skin surface of a user;

at least one electrically conductive contact segment held in contact with the at least one back non-cutting edge and the back surface of at least one of said plurality of electrically conductive blades for delivering an electric current from a power source to the at least one back non-cutting edge and into the unitary body defining the at least one of said plurality of the electrically conductive blades so that the electric current flows through the at least one of said plurality of electrically conductive blades and the at least one of said plurality of electrically conductive blades is heated across an entire length of the blade;

at least one wire conductor connecting between the power source and said at least one electrically conductive contact segment for directing flow of the electric current from the power source to said at least one electrically conductive contact segment; and said at least one electrically conductive contact segment having a higher electrically conductive resistance than said at least one wire conductor, thereby causing the at least one electrically conductive contact segment to increase in temperature and release heat towards the skin surface of the user when the electric current flows through said at least one electrically conductive contact segment and the blade cartridge is moved along the skin surface of the user.

3. A razor blade heating system comprising:

a plurality of electrically conductive blades each formed as a unitary body and being structured and disposed for receiving an electric current flow through said unitary body, and having a top side, a bottom side, a front a cutting edge, at least one back non-cutting edge and a back surface between the at least one back non-cutting edge and the top side, and the top side extending from the front cutting edge to the at least one back non-cutting edge, the bottom side extending from the front cutting edge to the back surface, and each of the plurality of electrically conductive blades further includes opposite outboard ends;

a blade cartridge structured and configured for containing said plurality of electrically conductive blades within said cartridge so that the front cutting edge of each of said plurality of electrically conductive blades is operably positioned in parallel, spaced relation for cutting hairs when the blade cartridge is moved along the skin surface of a user;

a pair of electrically conductive contact segments each held in contact with the at least one back non-cutting edge of each of said plurality of electrically conductive blades for delivering an electric current flow from a power source to the at least one back non-cutting edge of each of said plurality of electrically conductive blades and into the unitary body defining each of the plurality of electrically conductive blades so that the electric current flows through said plurality of electrically conductive blades and said plurality of electrically conductive blades are heated across an entire length of the blades;

at least one wire conductor connecting between the power source and said pair of electrically conductive contact segments for directing flow of the electric current from the power source to the pair of electrically conductive contact segments; and the pair of electrically conductive contact segments having a higher electrically conductive resistance than said at least one wire conductor, thereby causing the pair of electrically conductive contact segments to increase in temperature and release heat towards the skin surface of the user when the electric current flows through the pair of electrically conductive contact segments and the blade cartridge is moved along the skin surface of the user.

* * * * *